US006168018B1

(12) United States Patent
Ramsey et al.

(10) Patent No.: US 6,168,018 B1
(45) Date of Patent: Jan. 2, 2001

(54) ADJUSTABLE SOCKET RACK

(76) Inventors: Edward Ramsey, 38265 E. Benton Rd., Temecula, CA (US) 92592; Chris Vovos, 15505 Carrington Dr., La Mirada, CA (US) 90638

( * ) Notice: Under 35 U.S.C. 154(b), the term of this patent shall be extended for 0 days.

(21) Appl. No.: 09/398,717

(22) Filed: Sep. 20, 1999

(51) Int. Cl.[7] ..... B65D 85/20; A47F 7/00
(52) U.S. Cl. ..... 206/378; 211/70.6
(58) Field of Search ..... 706/375, 376, 706/378, 493; 211/70.6, 69.5

(56) References Cited

U.S. PATENT DOCUMENTS

| | | | | |
|---|---|---|---|---|
| 4,621,738 | * | 11/1986 | DeLucchi | 211/70.6 |
| 4,826,021 | * | 5/1989 | Burrell | 211/70.6 |
| 4,927,020 | * | 5/1990 | Randy | 206/378 |
| 5,228,570 | * | 7/1993 | Robinson | 206/378 |
| 5,398,823 | * | 3/1995 | Anders | 211/70.6 |
| 5,467,874 | * | 11/1995 | Whitaker | 206/378 |
| 5,501,342 | * | 3/1996 | Geibel | 206/378 |
| 5,645,177 | * | 7/1997 | Lin | 211/70.6 |
| 5,715,951 | * | 2/1998 | Dembicks | 211/70.6 |
| 5,725,107 | * | 3/1998 | Dembicks | 211/70.6 |
| 5,988,407 | * | 11/1999 | Battaglia | 211/51 |
| 6,092,655 | * | 7/2000 | Ernst | 206/378 |

OTHER PUBLICATIONS

Snap–On Tools Catalog pp. 68 & 69, Date Unknown.

* cited by examiner

*Primary Examiner*—Bryon P. Gehman

(74) *Attorney, Agent, or Firm*—Charles H. Thomas

(57) ABSTRACT

An adjustable rack for socket wrench sockets has an elongated mounting strip and a plurality of socket mounts that are removably coupled to the mounting strip. A longitudinally extending track having overhanging bearing ledges is defined in the mounting strip. Each socket mount has a base with a configuration that conforms to the configuration of the track in the mounting strip. The bases of the socket mounts may be inserted into the track of the mounting strip from either of the open ends of the track. The socket mounts are moved longitudinally along the mounting strip to selected positions which are spaced apart an appropriate distance to accommodate the thickness of the walls of the sockets placed atop the socket mounts. The socket mounts are thereupon tightened relative to the mounting strip. Each socket mount has an internally tapped bore extending through its structure from top to bottom. A clamping screw is threadably engaged in the internally tapped bore and may be advanced to bear downwardly against the floor of the track. This forces the upper surfaces of oppositely directed bearing lugs on the base of each socket mount upwardly against the overhanging bearing ledges defined on flanges alongside the track. Each socket mount is thereby firmly clamped at a selected position along the track. Each socket mount may be provided with a laterally acting spring to aid in releaseably holding a socket on its upwardly or outwardly projecting mounting post or stud of each socket mount.

14 Claims, 6 Drawing Sheets

ADJUSTABLE SOCKET RACK

SPECIFICATION

BACKGROUND OF THE INVENTION

1. Field of the Invention

The present invention relates to an adjustable rack for receiving sockets of different sizes that are used with a socket wrench.

2. Description of the Prior Art

Socket wrenches are widely utilized by mechanics and tradesmen for commercial purposes, as well as by individuals for home and auto repairs. A socket wrench includes a drive unit with a wrench handle that forms a lever arm which has a socket-receiving stud thereon. The socket-receiving stud is normally or always oriented perpendicular to the wrench handle. The socket-receiving studs employed in conventional socket wrench drives have a square cross-sectional configuration and are standardized at several drive sizes. For example, in this country, standard socket stud sizes measure one-quarter of an inch on each side, three-eighths of an inch on each side, or one-half of an inch on each side.

The various sockets employed with a socket wrench are generally annular in configuration and include a square opening at one end. This square opening is of an appropriate size to receive the socket wrench drive stud for which the socket is designed for use. Each socket has an opening at the opposite end which is of a size suitable to receive a nut or bolt head of a particular size.

Due to the considerable number of different size nuts with which a socket wrench may be utilized, quite a number of different sockets are necessary to provide the user with adequate flexibility in making repairs or constructing articles that employ bolts, nuts, or both bolts and nuts. Socket wrench sets are typically sold with thirteen or fourteen sockets of different sizes at a minimum, although larger wrench sets employ a considerably greater number of sockets. Although the drive size for each socket in a socket wrench set is the same, the outer diameter of each socket will vary, depending upon the size of the nut or bolt head which the socket is designed to receive.

To organize the sockets in a socket wrench set and to prevent sockets in a socket wrench set from becoming lost or misplaced, it is highly desirable to employ a wrench socket rack to receive and store the sockets that are not currently in use. A conventional rack of this type may employ pegs or posts that all have a uniform square cross section conforming to the socket drive size of the socket set involved. However, these socket mounts are spaced at specific longitudinal intervals that vary in spacing to accommodate sockets of different sizes.

While wrench socket racks having pegs spaced at specific intervals different distances apart may be adequate for some users, wrench socket racks with the pegs located at fixed locations lack the flexibility which other users have come to expect. For this reason wrench socket storage racks having movable pegs have been devised. Conventional movable peg socket rails employ a plurality of spring clips having outwardly projecting, convex portions at their center that are of a size suitable for receiving sockets having a particular drive opening size, and ends that resiliently engage opposing rails of a wrench socket rack. The individual socket-mounting spring elements may be moved longitudinally along the length of the rack to desired positions, spaced apart so as to accommodate sockets of the particular sizes in a user's socket set.

However, conventional movable peg socket rails are disadvantageous in that the spacing of the individual socket clips may be altered unintentionally since there is very little to prevent their movement lengthwise along the socket rails. Also, in order to create clip elements that may be adjustably positioned along the length of a socket rack, the structure of each clip element in a conventional wrench socket rack is such that it can be easily damaged or bent. Consequently, while socket wrench racks with movable pegs do exist, they have structural and functional features that are unacceptable to many users.

SUMMARY OF THE INVENTION

The present invention involves a wrench socket rack having a plurality of different socket mounts that can not only be adjustably positioned along the length of a rack, but which can also be releaseably secured in position when desired. Unlike conventional movable spring clip socket mounts, the socket mounts of the present invention employ clamps that are engageable and disengageable to immobilize a socket at a selected position along the length of a track, or to allow the position of each socket mount to be adjusted along the track along the track, at the discretion of the user.

In one broad aspect the present invention may be considered to be an adjustable rack for wrench sockets comprising an elongated mounting strip and a plurality of socket mounts. The mounting strip defines an outwardly facing track thereon of uniform cross section throughout. The track has opposing lateral sides. A pair of elongated, inwardly facing bearing ledges are formed along both of the lateral sides of the track. Those bearing ledges are coextensive in length with the track. Each one of the plurality of socket mounts includes a base, a socket-engaging stud, and a clamp. The base has a pair of opposing bearing lugs that extend laterally beneath and face the bearing ledges alongside the track. This construction permits longitudinal movement of the base along the track while maintaining the base engaged with the track. Each socket-engaging stud projects outwardly from the base of its socket mount and away from the track. The clamp is selectively releaseable to permit the base to be moved to a selected position along the track and engaged to press the lugs against the bearing ledges. This immobilizes the base relative to the track. With this construction each socket mount is independently adjustable relative to the track.

While the clamp mechanism may take different forms, each of the socket mounts preferably has an internally tapped bore extending through its socket-engaging stud and through its base. This bore is aligned perpendicular to the track. The clamp is preferably formed as a screw that is threadably engaged with the internally tapped bore. The screw may be advanced toward the track to bear against the track, thereby forcing the lugs in the opposite direction against the bearing ledges. Alternatively, the screw may be advanced away from the track so that the lugs no longer press against the bearing ledges to permit movement of the base of the socket mount along the track to a new position.

To provide a rugged construction, the base with its laterally projecting lugs and the socket-engaging stud of each socket mount are formed together as a unitary, solid metal structure. Such a construction ensures that the socket mount will not be damaged by the very strong forces and impacts that are likely to be exerted against it during use. However, when the socket-engaging stud post is formed as a rigid structure, it can be difficult to achieve just the right dimension so that the drive opening of a socket will be securely held on the stud by friction, yet removed without undue difficulty.

Accordingly, in a preferred construction, each socket mount is preferably provided with a socket engagement spring attached to the socket engagement stud. This spring is oriented to act in a lateral direction from the socket-engaging stud to aid in releaseably holding a wrench socket on the stud. By utilizing a spring in conjunction with a solid socket-mounting stud or post, ruggedness of construction is achieved accompanied by a resilient biasing means for holding a socket piece on a stud in a manner that allows release of the wrench socket from the stud when desired by the user.

In a preferred construction the socket-engaging stud or post has a top remote from the base and lateral sides. Preferably the spring is a leaf spring having an anchored end secured to the top of the stud and a free end projecting downwardly along one of the lateral sides of the stud. The leaf spring is bowed concave outwardly from the socket-engaging stud. By providing each solid metal stud with a leaf spring in this manner, a wrench socket can be held firmly but not inextricably in position on the rack.

In another broad aspect the invention may be considered to be an adjustable socket wrench rack comprising an elongated mounting strip defining an elongated track of uniform cross section throughout and equipped with an outwardly facing floor and a pair of laterally separated, inwardly facing elongated bearing surfaces located above the floor on both sides of the track. The socket wrench rack is also comprised of a plurality of socket mounts of modular construction. Each socket mount includes: a mounting base having an inwardly facing bottom surface facing the floor of the track and a pair of opposing lugs projecting laterally beneath the elongated bearing surfaces, a socket-mounting post projecting outwardly from the base for receiving a wrench socket thereon in snug fitting engagement therewith, and a clamp that is releaseable to permit longitudinal movement of the mounting base along the track and which is engageable to press the lugs against the bearing surfaces. Engagement of the clamp thereby immobilizes the mounting base of the socket mount relative to the track.

In still another broad aspect the invention may be considered to be a wrench socket rack for accommodating a plurality of wrench sockets. The rack of the invention is comprised of an elongated supported and a plurality of socket pegs. The support defines thereon an elongated track and a pair of bearing surfaces overhanging the track on opposites sides thereof. Each of the mounting pegs includes a base that fits into the track and which has a pair of opposing, laterally projecting lugs extending beneath the bearing surfaces; a stud projecting outwardly from the base and away from the track and sized to receive a wrench socket thereon in frictional engagement therewith; and a clamp that is releaseable to permit the base to slide longitudinally to a selected position along the track and which is engageable to press the lugs against the bearing surfaces to thereby lock the peg at a selected position along the track.

The invention may be described with greater clarity and particularity by reference to the accompanying drawings.

DESCRIPTION OF THE EMBODIMENT

Figure 1:
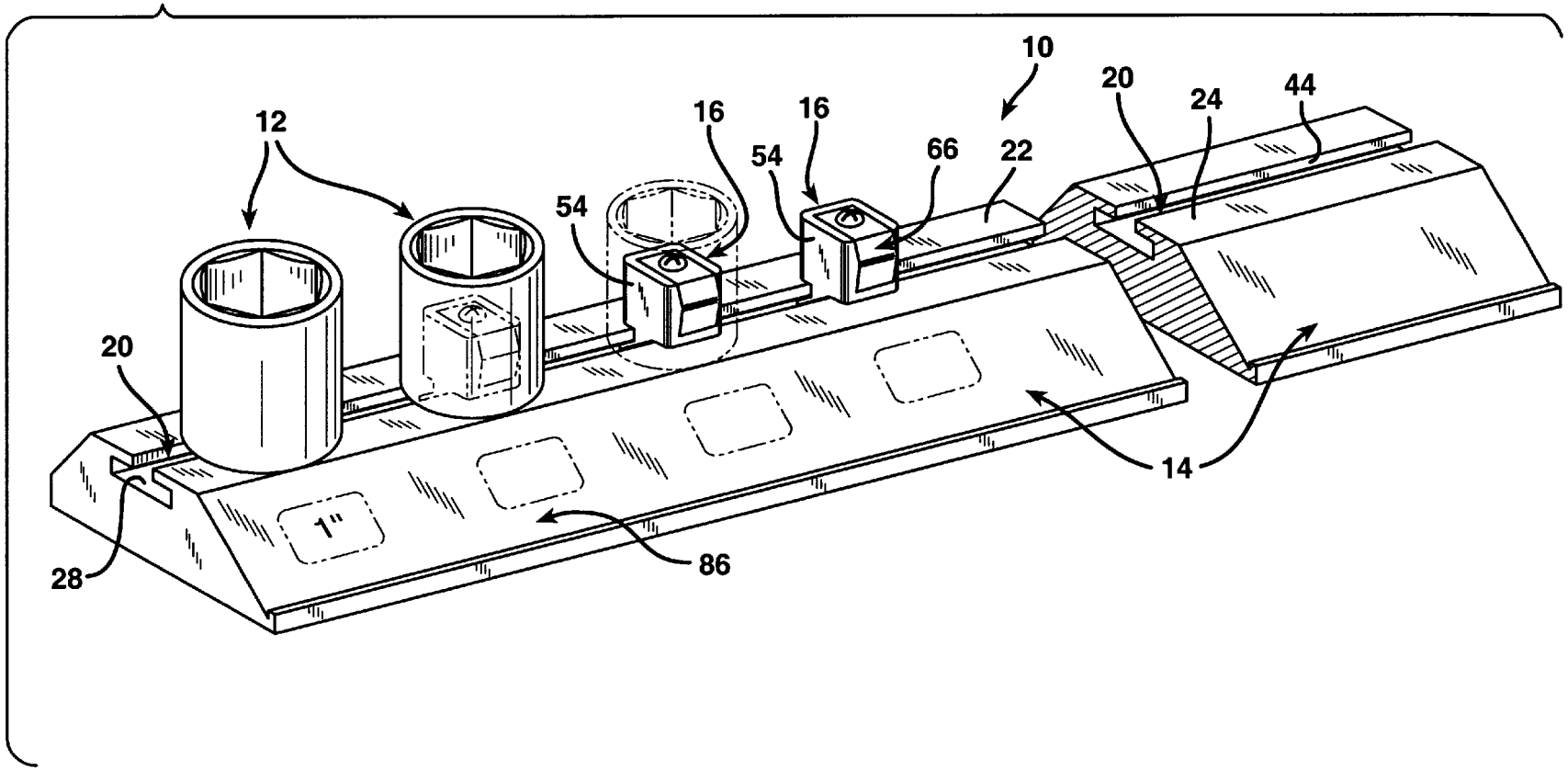
FIG. 1 is a perspective view of one preferred embodiment of a wrench socket rack according to the invention.
Figure 6:
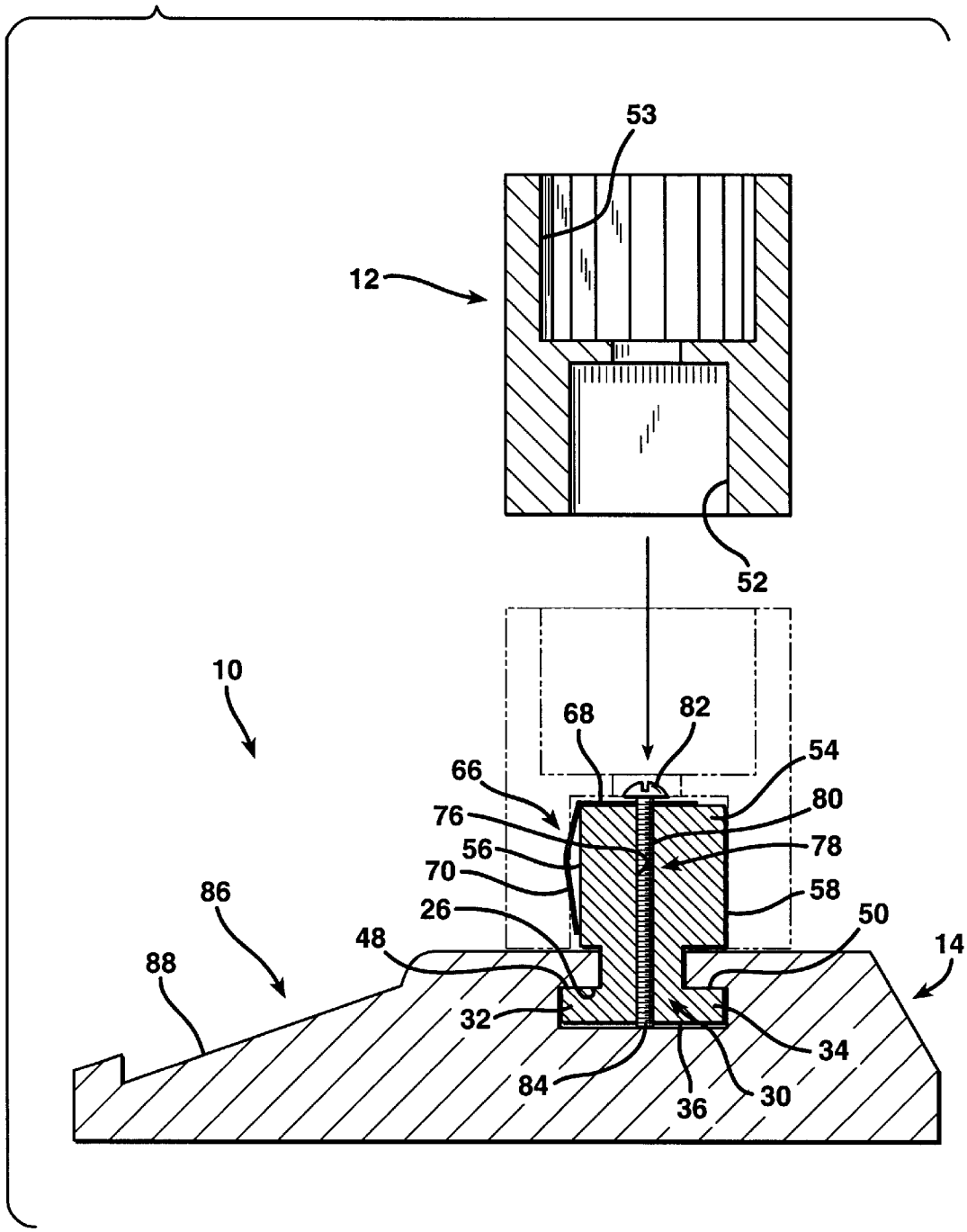
FIG. 6 is a sectional elevational view taken along the lines 6—6 of FIG. 2.

FIG. 1 illustrates a wrench socket rack 10 according to the invention for accommodating a plurality of wrench sockets 12, several of which are illustrated in FIG. 1. Each socket 12 has a square drive opening 52 at one end and a nut or bolt-head-engaging opening 53 at its opposite end, as best depicted in FIG. 6. The wrench socket rack 10 is comprised of an elongated support 14, which is formed as an extruded mounting strip structure having a uniform cross section throughout its entire length, and a plurality of socket mounts or pegs 16, each one of which may be of the type depicted in FIG. 4.

Figure 2:
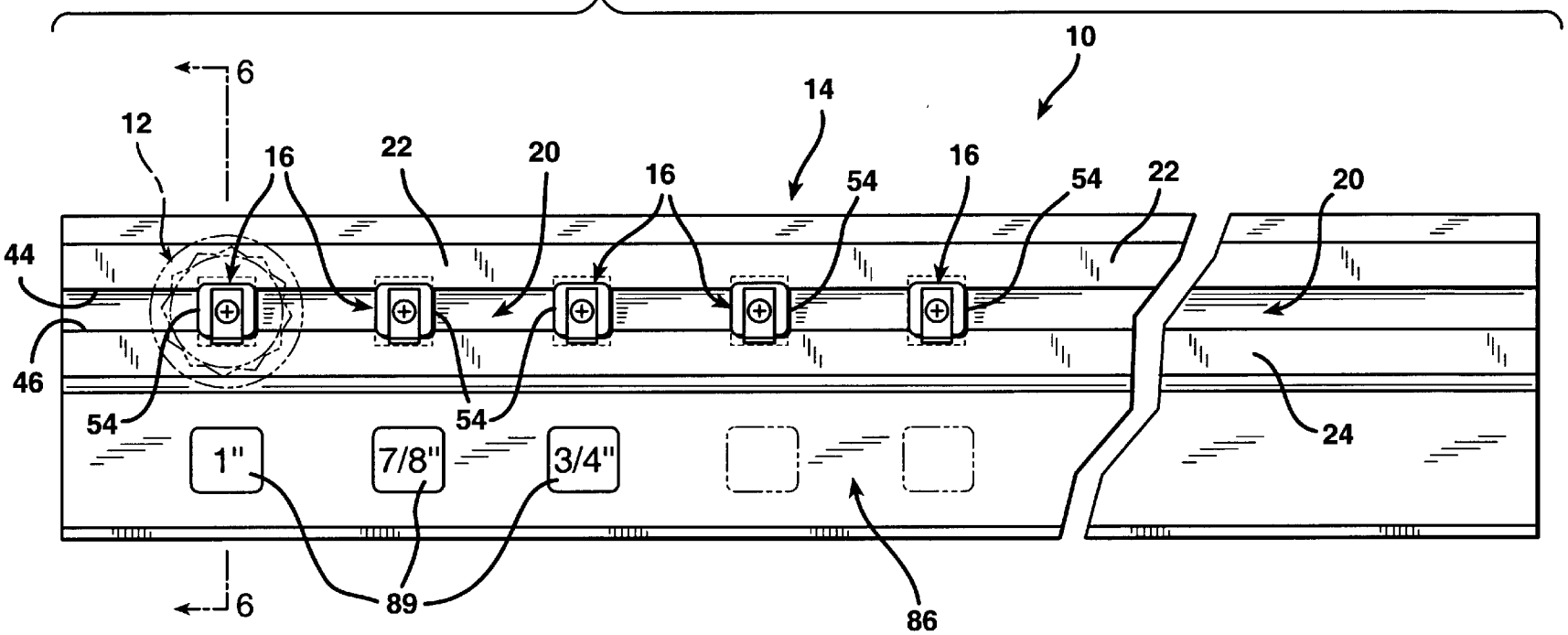
FIG. 2 is a top plan view of the wrench socket rack of FIG. 1.
Figure 3:
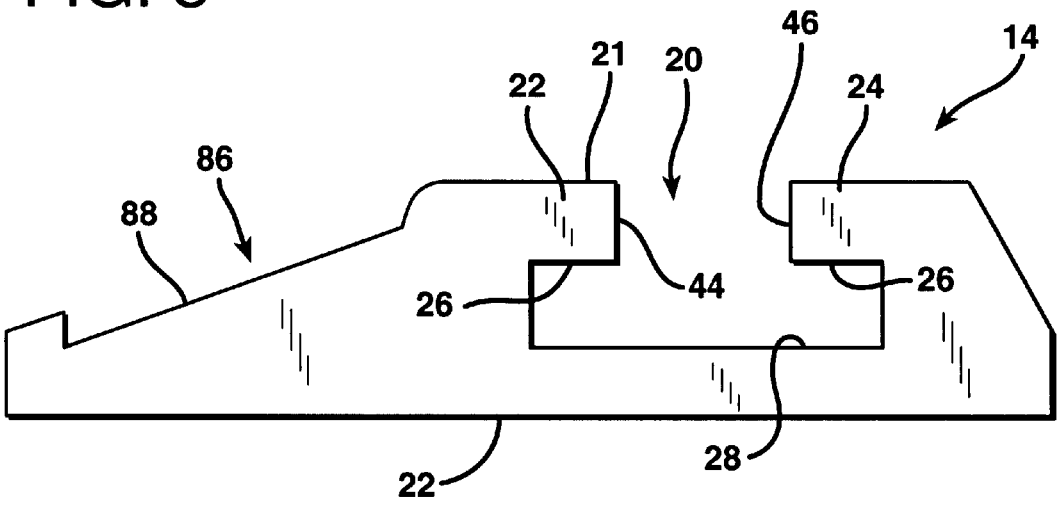
FIG. 3 is an end view of the elongated mounting strip support employed in the embodiment of FIGS. 1 and 2.

As best illustrated in FIGS. 1–3, the elongated support 14 is formed with an elongated track 20, which has the cross-sectional configuration of an inverted "T". The mounting strip 14 has a flat bottom 22 and a flat socket-mounting surface 21 located above the flat bottom 22. The track 20 is formed as a channel beneath the flat socket-mounting surface 21. The elongated support 14 is an extruded aluminum structure which forms a pair of overhanging flanges 22 and 24 that are below the flat upper surface 21 and that extend along the sides of the track 20 and which define downwardly or inwardly facing bearing surfaces or ledges 26 on both sides of the track 20. The bearing surfaces 26 overhang and face the upwardly or outwardly facing track floor 28.

Figure 4:
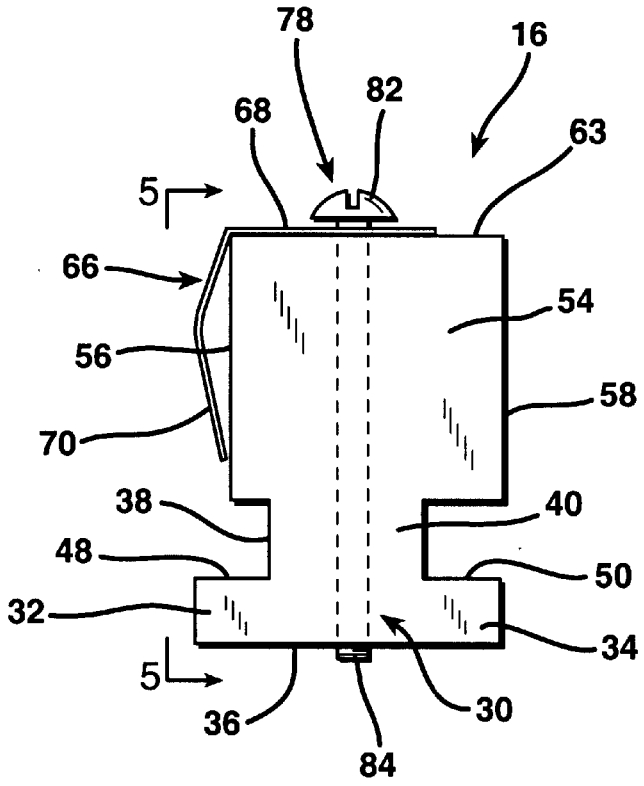
FIG. 4 is an isolated view of a single one of the plurality of socket pegs employed in the embodiment of FIGS. 1–2.

The socket mounts have different cross-sectional configurations, depending upon the drive size which the sockets 12 are designed to accommodate. However, irrespective of the drive stud openings that the socket mounts are designed to receive, all of the socket mounts will include a socket mount base 30 that has a pair of opposing bearing lugs 32 and 34. FIG. 4 illustrates a socket mount 16 designed to receive sockets 12 that have a square opening to receive a one-half inch square socket wrench drive stud. The lugs 32 and 34 project to opposite sides of the flat base undersurface 36 of the socket mount 16. The lugs 32 and 34 are defined by vertical surfaces 38 and 40 that are spaced a predetermined distance apart so that the neck of each socket mount 16 above the base 30 projects upwardly through the gap at the top of the track 20 defined between the vertical, mutually facing surfaces 44 and 46 of the overhanging flanges 22 and 24.

Figure 5:
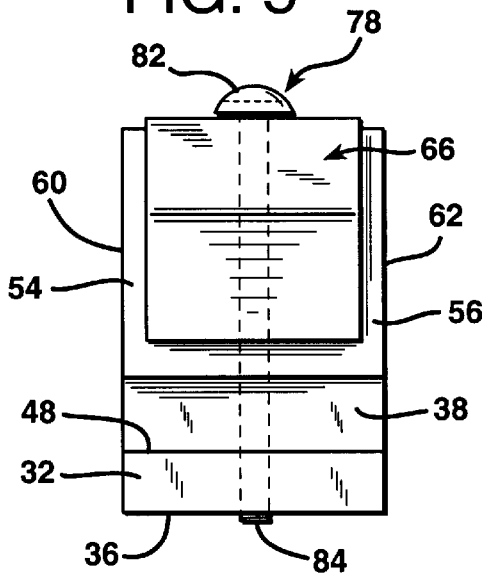
FIG. 5 is a left-side elevational view of the socket peg of FIG. 4

As illustrated in FIG. 5, the opposing lugs 32 and 34 extend laterally beneath the bearing ledges 26 that are formed above the track 20. The lugs 32 and 34 are just thick enough, is measured between their upper, flat, horizontal surfaces 48 and 50 relative to the underside 36 of the base 30, to fit with a slight clearance into the T-shaped track 20. For example, in the embodiment of the mounting strip 22 depicted in FIG. 3, the floor 28 of the track 20 may be 0.510 inches wide and the mounting strip 14 may be extruded so that the bearing ledges 26 lie at a distance of 0.125 inches above the track floor 28. The gap at the top of the track, as defined by the distance between the vertically facing surfaces 44 and 46 of the track flanges 22 and 24, may be 0.260 inches. For a track 20 having these dimensions, the flat undersurface 36 of the socket mount 16 shown in FIG. 4 may be 0.500 inches wide, while the distance between the mutually coplanar upper surfaces 48 and 50 of the lugs 32 and 34 from the undersurface 36 of the base 30 may be 0.110 inches. The vertical surfaces 38 and 40 may, for example, extend upwardly a distance of at least 0.135 inches so as to clear the flat, upper surface 21 of the mounting strip 14 in which the track 20 is formed.

To accommodate sockets 12 having a one-half square drive opening 52, as illustrated in FIG. 6, the socket mount 16 is provided with a socket-engaging stud 54 of rectangular cross section and which has upright, vertically oriented, laterally facing side surfaces 56 and 58 that are located 0.425 inches apart, and upright, mutually parallel end faces 60 and 62 that are located 0.495 inches apart, as viewed in FIG. 5.

The structures forming the socket mount bases 30 and the socket-engaging studs 54 of each socket mount 16 are formed by cutting off sections of extruded aluminum bar stock. This bar stock has a uniform cross-sectional configuration as depicted in FIG. 4.

The socket-mounting stud 54 has a flat, upper top surface 63 that is parallel to the undersurface 36 of the socket mount base 30. The overall height of the socket mount 16, as measured by the distance between the surfaces 36 and 63 is preferably about 0.72 inches. Each of the socket mounts 16 is formed with an internally tapped bore 76, visible in FIG. 6, which extends entirely through the height of the socket mount 16 from top to bottom, with openings at both the flat upper top surface 63 and the flat bottom undersurface 36. The internally tapped bore 76 may have a pitch diameter of one-eighth of an inch, for example.

The width of each socket mount stud 54 is slightly thinner in a lateral direction than in a transverse direction so as to accommodate a socket-engaging spring 66, as illustrated in FIGS. 4, 5, and 6. The socket-engaging spring 66 is a leaf spring having an anchored end 68 that is secured to the top of the stud 54 and a free end 70 that projects downwardly along the lateral side 56 and is bowed convex outwardly from the surface 56 of the stud 54, as illustrated in FIG. 4.

Each socket mount 16 is provided with a clamping screw 78, having an externally threaded shank 80 and an oval blade head 82 as illustrated in FIG. 6. The shank 80 of the clamping screw 78 is slightly longer than the overall height of the socket mount 16 so that the tip 84 of the clamping screw 78, when fully tightened down into the internally tapped bore 76, not only clamps and immobilizes the anchored end 68 of the leaf spring 66 against the top upper surface 63 of the stud 54 of the socket mount 16, but also projects through the flat undersurface 36 of the socket mount 16 and bears against the floor 28 of the track 20. The clamping screw 78 is thereby engaged with the internally tapped bore 76 and is tighteneable to protrude through the socket mount base 30 to bear against the floor 28 of the track 20. The shank 80 of the clamping screw 78 is aligned perpendicular to the floor 28 of the track 20. This forces the lugs 32 and 34 upwardly against the bearing surfaces 26 of the track 20 to tightly immobilize the socket mount 16 at a selected position along the length of the track 20, as best illustrated in FIG. 2.

Alternatively, the clamping screw 78 may be backed out of the internally tapped bore 76 a few turns so that the shank tip 84 no longer protrudes from the bottom surface 36 of the socket mount base 30. This allows the base 30 to be inserted into the track 20 from either end of the mounting strip 14 and moved longitudinally along the track 20 to a selected position. Once at the desired location, the clamping screw 78 is again tightened by engaging the screw head 82 with a blade screwdriver, thus forcing the lug surfaces 48 and 50 tightly up against the bearing surfaces 26 of the track 20 to hold the socket mount 16 at a selected position along the track 20. The clamping screw 76, when tightened downwardly, bears against the track floor 28 to immobilize its socket mount 16 relative to the mounting strip 14.

As illustrated in FIG. 2, a plurality of socket mounts 16 may be positioned in the track 20 to accommodate sockets 12 of different sizes. For example, the socket mounts 16 will be closely spaced together when sockets 12 of a relative small outer diameter are to be mounted upon the socket mounts 16. Thus, the adjustable rack 10 may be utilized to accommodate a considerable number of sockets 12 having relatively small nut openings 53 to receive nuts of a small size. Conversely, where the nut opening 53 of a socket 12 is large, the outer diameter of the socket 12 must be increased as well. However, by adjusting the spacing between the socket mounts 16 of the adjustable socket-mounting rack 10 of the invention, a relatively small number of socket mounts 16 are employed in the mounting strip 14, but are spaced appropriately to accommodate sockets 12 of larger outer diameters.

The leaf spring 66 is provided to act laterally outwardly from the socket-mounting stud or post 54 to aid in releaseably holding the wrench socket 12 on the socket-mounting stud 54. That is, when the socket mounts 16 are installed in the mounting strip 14, as illustrated in FIGS. 1 and 2, the sockets 12 are releaseably installed on the socket mounts 16 by placing the socket drive openings 52 directly above the socket mounts 16, and forcing the sockets 12 downwardly so that walls of the socket drive openings 52 of the sockets 12 compress the springs 66 laterally inwardly to engage the sockets 12 on the socket mount studs or posts 54. The dimensions of the sockets mount posts 54 relative to the socket drive opening 52 of the sockets 12 is such that the leaf spring 66 will be resiliently deflected slightly so as to reduce its outward bow relative to the lateral side 56. This resilient deflection provides a sufficient lateral force to resiliently lodge the socket 12 onto the socket mount stud 54 and hold it there even if the adjustable rack 10 is severely jostled or even turned over. However, the force of the leaf spring 66 is not so great as to prevent ready removal of a socket 12 relative to a socket mount 16 by simply pulling the socket 12 upwardly from the socket mount stud 54. The leaf spring 66 thereby aids in releaseably holding the wrench socket 12 on the socket-mounting post 54 of a socket mount 16.

The mounting strip of the invention may be configured in different ways. The mounting strip 14, illustrated in FIGS. 1–3 and 6, has a flat undersurface 22 and a flat top surface 21 into which the track 20 is formed. The track floor 28 lies parallel to the flat undersurface 22 and also the flat top surface 21.

The mounting strip 14 includes a flat, label-mounting portion indicated at 86 in FIGS. 1–3. As illustrated, the label-mounting portion 86 defines a label channel 88 that extends longitudinally and at an inclination relative to the flat undersurface 22 of the mounting strip 14. The label channel 88 accommodates a label 89 for the particular size of socket nut opening 53 for the socket 12 which the socket mount 16 secured adjacent thereto is designed to receive. In this way the user can readily see just which size socket 12 to place atop each of the socket mounts 16, since a label 89 having an indicia of correct socket size for that position on one side and a pressure sensitive adhesive on its other side may be secured to the label channel 88 laterally adjacent to a socket mount 16 which is correctly spaced from adjacent socket mounts 16 to receive a wrench socket 12 of the indicated size.

Figure 9:
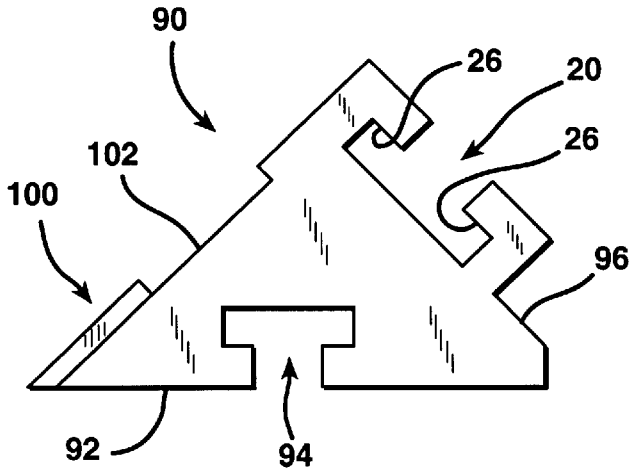
FIG. 9 is an end view of a different embodiment of an elongated mounting strip support for use in a wrench socket rack according to the invention.
Figure 10:
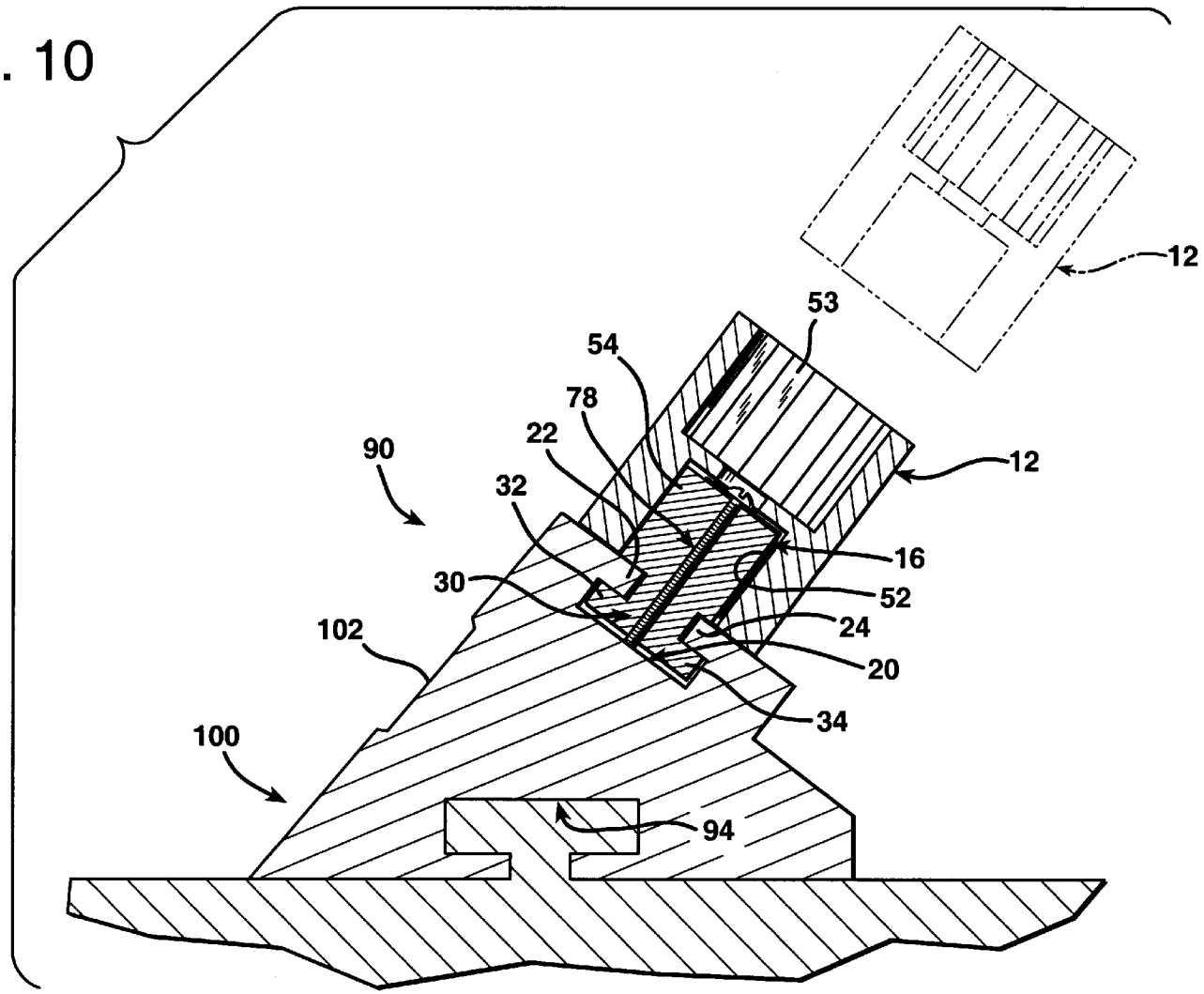
FIG. 10 is a sectional elevational view showing a wrench socket rack according to the invention employing the elongated support of FIG. 9 and the socket peg of FIG. 4.

The mounting strip 14, illustrated in FIGS. 1–3, is appropriate for many situations in which a user wishes for the sockets 12 to be mounted on socket mounts having vertically upwardly aligned mounting orientations. In other situations, however, the user may wish for the socket-mounting studs 54 to be oriented at an incline. Such a preference is appropriate for sockets positioned in a tool chest tray, since the tray carrying handle might otherwise interfere with withdrawal and replacement of sockets 12 onto the adjustable rack of the invention. FIG. 9 illustrates a mounting strip 90 having an alternative configuration from that of the mounting strip 14 shown in FIGS. 1–3. The mounting strip 90 has a flat undersurface 92 into which a T-shaped toolbox mounting channel 94 is defined. The mounting channel 94 fits onto a corresponding rail into a toolbox, and thereby holds the mounting rack 90 in position relative to the toolbox, as illustrated in FIG. 10.

The mounting strip 90 has a flat mounting surface 96 which is oriented at a forty-five degree angle relative to the flat undersurface 92. Like the mounting strip 14, the mounting strip 90 defines a track 20 with overhanging bearing ledges 26 to receive the same sockets mounts 16 as the mounting strip 14. In the embodiment of FIG. 9, the mounting strip 90 is provided with a label-mounting surface 100 that lies adjacent to the socket-mounting surface 96 and which is oriented perpendicular thereto. The label-mounting surface 100 also lies at a forty-five degree angle relative to the flat undersurface 92. The label-mounting surface 100 defines a longitudinally extending label channel 102 configured to receive labels for appropriate socket sizes to be positioned at socket mounts 16 located adjacent thereto.

Figure 7:
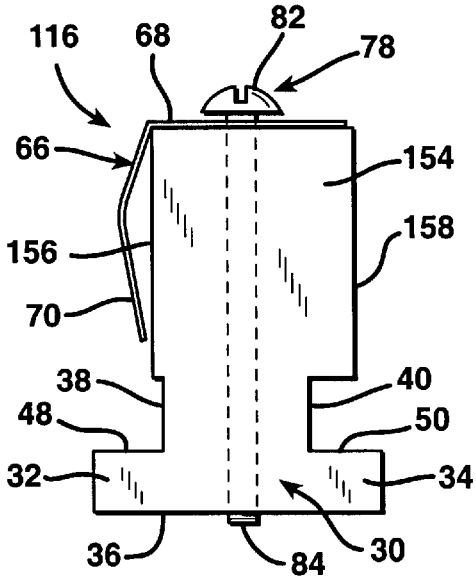
FIG. 7 is a isolated end view of an alternative embodiment of a socket peg for the wrench socket rack of the invention designed for use with sockets having a different drive size than the socket mounts shown in FIGS. 4, 5, and 6.

Socket mounts for sockets having stud drive openings of a different size than that of the socket mount 16 will have a somewhat different configuration from the socket mount 16. For example, FIG. 7 illustrates a socket mount 116 that is configured to receive a socket 12 having a square stud drive opening three-eighths of an inch on each side. The base 30 of the socket mount 116 is identical to the base 30 of the socket mount 16. However, the stud 154 of the socket mount 116 has a somewhat different configuration. Specifically, the lateral width of the socket-engaging stud 154, as measured between the laterally facing, vertically oriented surfaces 156 and 158 is 0.325 inches. The end faces of the socket-mounting stud or post 154 are spaced 0.370 inches apart, thus leaving a 0.005 inch clearance in that direction to receive a socket 12 having a square wrench socket stud opening 0.375 inches on a side. As with the socket mount 16, the socket mount 116 includes a leaf spring 66 to aid in releaseably holding a socket 12 on the mounting stud or post 154 and a clamping screw 78 that extends through the socket mounts 116 from top to bottom to bear against the channel floor 28 of either the mounting strip 14 or the mounting strip 90.

Figure 8:
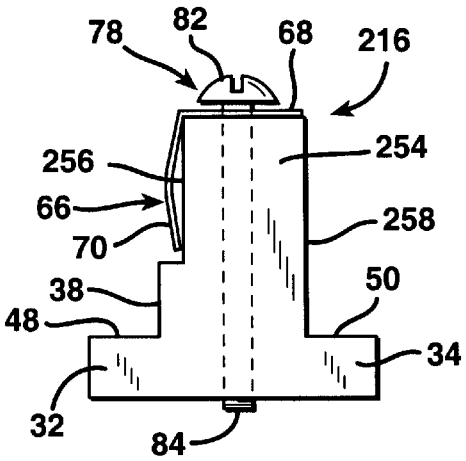
FIG. 8 is an isolated end elevational view of still another socket peg designed for use with sockets having a still smaller drive size then the socket mounts of FIGS. 4–7.

FIG. 8 illustrates a socket mount 216 having an upright mounting post or stud 254 of a cross-sectional configuration suitable for receiving sockets 12 having stud drive openings therein that are square and which measure one-quarter of an inch on each side. The upper portion of the socket stud 254 of the socket mount 216 has a lateral width 0.200 inches as measured between the vertically oriented lateral faces 256 and 258. The width of the socket-mounting stud or post 254 as measured between the end faces of the socket mount 216 is 0.245 inches. As with the socket mounts 16 and 116, the socket mount 216 employs a leaf spring 66 and a socket clamping screw 78.

The socket mounts 16, 116, and 216 all have bases 30 of an identical configuration. Consequently, the socket mounts 16, 116, or 216 may be mounted in the tracks 20 by inserting their bases 30 into either of the open ends of the tracks 20 in either of the mounting strips 14 or 90. The clamping screw 78 is loosened during the socket mount installation process. The base 30 of the socket mount is pushed into the track 20 from either end and moved longitudinally to a selected position. The inwardly facing bottom surface 36 of the socket mount base 30 faces the floor 28 of the track 28. The pair of opposing lugs 48 and 50 project laterally beneath the elongated bearing surfaces 26.

All of the sockets 16, 116, and 216 may be adjustably secured to the tracks 20 of either of the mounting strips 14 or 90 shown. Once the socket mount has been moved to the selected position along the track 20, spaced an appropriate distance from the next adjacent socket mount, the clamping screw 78 is tightened, thus forcing the clamping screw tip 84 downwardly against the track floor 28. This causes the lugs 48 and 50 of the base 30 to be pushed upwardly to press tightly against the overhanging bearing surfaces 26 of the track flanges 22 and 24. The socket mount is thereby securely, but releaseably fastened in position.

Undoubtedly, numerous variations and modifications of the invention will become readily apparent to those familiar with socket wrenches and socket wrench racks. For example, the track 20 and socket mount base 30 need not necessarily be formed with horizontal and vertical surfaces, but could be formed in a dovetail configuration or with other, different cross sections. Also, springs other than leaf springs can be employed to provide a resilient bias for each socket mount to releaseably hold a socket in position thereon. For example, a laterally acting coil spring could be utilized in a lateral bore directed into one face of a socket mount. Such a spring could act laterally outwardly against a detent sphere to hold a socket in position on a socket mount stud. Accordingly, the claims should not be construed as limited to the specific embodiments of the invention depicted and described.

What is claimed is:

1. An adjustable rack for wrench sockets comprising:

an elongated mounting strip defining an outwardly facing track thereon of uniform cross section throughout and having opposing lateral sides, and a pair of elongated, inwardly facing bearing ledges along both of said lateral sides of said track and coextensive with said track, a plurality of modular socket mounts each of which includes:

a base positioned in said track and having a pair of opposing bearing lugs that extend laterally beneath said bearing ledges and face said bearing ledges, thereby permitting longitudinal movement of said base along said track while maintaining said base engaged with said track, a socket-engaging stud projecting outwardly from said base and away from said track, a clamp that is selectively releaseable to permit said base to be moved to a selected position along said track and engaged to press said lugs against said bearing ledges, thereby immobilizing said base relative to said track, whereby each of said socket mounts is independently adjustable relative to said track, and a socket engagement spring attached to said socket-engaging stud and said spring is oriented to act in a lateral direction from said stud to aid in releaseably holding a wrench socket on said stud, and wherein said stud has a top remote from said base and lateral sides and said spring is a leaf spring having an anchored end secured to said top of said stud and a free end projecting downwardly along one of said lateral sides and bowed convex outwardly therefrom.

2. An adjustable rack for wrench sockets comprising:

an elongated mounting strip defining an outwardly facing track thereon of uniform cross section throughout and having opposing lateral sides, and a pair of elongated, inwardly facing bearing ledges along both of said lateral sides of said track and coextensive with said track, a plurality of modular socket mounts each of which includes:

a base positioned in said track and having a pair of opposing bearing lugs that extend laterally beneath said bearing ledges and face said bearing ledges, thereby permitting longitudinal movement of said base along said track while maintaining said base engaged with said track, a socket-engaging stud projecting outwardly from said base and away from said track, a clamp that is selectively releaseable to permit said base to be moved to a selected position along said track and engaged to press said lugs against said bearing ledges, thereby immobilizing said base relative to said track, whereby each of said socket mounts is independently adjustable relative to said track, and wherein each of said socket mounts has an internally tapped bore extending through said socket-engaging stud and through said base thereof and aligned perpendicular to said track, and said clamp is formed as a screw threadably engaged with said internally tapped bore for advancement toward said track to bear against said track, thereby forcing said lugs against said bearing ledges, and for advancement away from said track to permit movement of said base along said track.

3. An adjustable rack according to claim 2 wherein said track has a flat floor and said bearing ledges overhang said track floor and are directed toward each other, and said lugs are delineated by faces in opposing sides of said socket mounts that extend parallel to said track and are oriented perpendicular to said track floor.

4. An adjustable rack according to claim 2 wherein said mounting strip has a flat undersurface and a top surface including a socket-mounting portion into which said track is formed, and said track has a floor that lies parallel to said flat undersurface.

5. An adjustable rack according to claim 4 wherein said mounting strip includes a label-mounting portion that lies adjacent to said socket-mounting portion, and said label-mounting portion defines a label channel that extends longitudinally and at an inclination relative to said flat undersurface.

6. An adjustable rack according to claim 2 wherein said mounting strip has a flat undersurface into which a longitudinal T-shaped toolbox-mounting channel is defined, a socket-mounting surface into which said track is formed and which is oriented at a forty-five degree angle relative to said flat undersurface, and a label-mounting surface that lies adjacent to said socket-mounting surface and is oriented perpendicular thereto and at a forty-five degree angle relative to said flat undersurface, and a longitudinally extending label channel is defined in said label-mounting surface.

7. An adjustable wrench socket rack comprising:

an elongated mounting strip defining an elongated track of uniform cross section throughout and equipped with an outwardly facing floor and a pair of laterally separated, inwardly facing, elongated bearing surfaces located above said floor on both sides of said track, and a plurality of socket mounts of modular construction, each socket mount including:

a mounting base having an inwardly facing bottom surface facing said floor of said track and a pair of opposing lugs projecting laterally beneath said elongated bear surfaces, a socket-mounting post projecting outwardly from said base for receiving a wrench socket thereon in snug fitting engagement therewith, and a clamp that is releaseable to permit longitudinal movement of said mounting base along said track and engageable to press said lugs against said bearing surfaces, thereby immobilizing said mounting base relative to said track, and wherein each of said socket mounts is formed with an internally tapped bore that extends entirely through said base and through said socket-mounting post, and said clamp for each of said socket mounts is a screw engaged with said internally tapped bore thereof and tightenable to protrude through said base to bear against said track so as to force said lugs against said bearing surfaces, and releaseable to permit longitudinal movement of said socket mounts relative to said track.

8. An adjustable wrench socket rack according to claim 7 wherein each of said socket mounts further comprises a spring that acts laterally outwardly from said socket-mounting post to aid in releaseably holding a wrench socket on said socket-mounting post.

9. An adjustable wrench socket rack according to claim 8 wherein said spring is a leaf spring having an anchored end secured to said socket mount and a free end located alongside said socket-mounting post.

10. An adjustable wrench socket rack according to claim 7 wherein said mounting strip has a flat bottom and a flat socket-mounting surface located above said flat bottom and said track is formed as a channel in said flat socket-mounting surface.

11. An adjustable wrench socket rack according to claim 10 wherein said flat socket-mounting surface is parallel to and located above said flat bottom.

12. An adjustable wrench socket rack according to claim 10 wherein said flat socket-mounting surface is located above and inclined relative to said flat bottom.

13. A wrench socket rack for accommodating a plurality of wrench sockets comprising:

an elongated support defining thereon an elongated track and a pair of bearing surfaces overhanging said track on opposite sides thereof, a plurality of socket pegs each of which includes: a base that fits into said track and which has a pair of opposing, laterally projecting lugs extending beneath said bearing surfaces; a stud projecting outwardly from said base and away from said track and sized to receive a wrench socket thereon in frictional engagement therewith; and a clamp that is releaseable to permit said base to slide longitudinally to a selected position along said track and engageable to press said lugs against said bearing surfaces to thereby lock said peg at a selected position along said track, and wherein an internally tapped bore is defined in each of said socket pegs to extend entirely through the structure thereof from said stud to said base, and said clamp is formed as a screw threadably engaged in said tapped bore and directed toward said track and said screw has a bearing tip that protrudes from said bore through said base to bear against said track when said screw is advanced into said bore toward said base.

14. A wrench socket rack according to claim 13 further comprising a laterally acting spring secured to each stud of each socket peg to aid in releaseably retaining wrench sockets on said socket pegs.

* * * * *